US009244419B2

(12) United States Patent
Hatazaki

(10) Patent No.: US 9,244,419 B2
(45) Date of Patent: Jan. 26, 2016

(54) SHEET COMPRESSION APPARATUS AND IMAGE FORMING APPARATUS

(75) Inventor: Kazunari Hatazaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/568,801

(22) Filed: Aug. 7, 2012

(65) Prior Publication Data

US 2013/0043650 A1 Feb. 21, 2013

(30) Foreign Application Priority Data

Aug. 19, 2011 (JP) ..... 2011-179666

(51) Int. Cl.

| | |
|---|---|
| ***B65H 5/02*** | (2006.01) |
| ***G03G 15/00*** | (2006.01) |
| ***B65H 5/06*** | (2006.01) |
| ***B65H 15/00*** | (2006.01) |

(52) U.S. Cl.

CPC ..... *G03G 15/6558* (2013.01); *B65H 5/062* (2013.01); *B65H 15/00* (2013.01); *G03G 15/6582* (2013.01); *B65H 2301/33312* (2013.01); *B65H 2301/34112* (2013.01); *B65H 2301/5123* (2013.01); *B65H 2511/224* (2013.01); *B65H 2515/34* (2013.01); *B65H 2801/06* (2013.01)

(58) Field of Classification Search

CPC ..... B65H 15/00; B65H 2301/5123; B65H 2301/33312; B65H 2301/34112

USPC ..... 271/273, 274

See application file for complete search history.

(56) References Cited

U.S. PATENT DOCUMENTS

| | | | | |
|---|---|---|---|---|
| 5,106,075 | A * | 4/1992 | Wafford et al. | 271/186 |
| 7,108,260 | B2 * | 9/2006 | Biegelsen et al. | 271/303 |
| 7,722,039 | B2 | 5/2010 | Shoji | |
| 8,066,278 | B2 * | 11/2011 | Sanada et al. | 271/225 |
| 2005/0035539 | A1 | 2/2005 | Hashimoto | |
| 2005/0152724 | A1 | 7/2005 | Konagaya | |
| 2006/0285903 | A1 | 12/2006 | Yamane | |
| 2008/0240821 | A1 * | 10/2008 | Shoji et al. | 399/395 |
| 2011/0058872 | A1 | 3/2011 | Ferrara | |
| 2011/0142514 | A1 * | 6/2011 | Ando et al. | 399/388 |
| 2011/0158724 | A1 | 6/2011 | Fujita | |

(Continued)

FOREIGN PATENT DOCUMENTS

| | | | |
|---|---|---|---|
| JP | 2001-092332 | A | 4/2001 |
| JP | 2008-298925 | A | 12/2008 |

(Continued)

OTHER PUBLICATIONS

U.S. Appl. No. 13/568,781, filed Aug. 7, 212, Yoshiyasu Satomi.

*Primary Examiner* — Howard Sanders

(74) *Attorney, Agent, or Firm* — Canon USA, Inc., IP Division

(57) ABSTRACT

A sheet compression apparatus includes a pair of nipping members configured to be movable so as to contact and separate from each other and to compress a sheet while the sheet is nipped, and a contact/separation mechanism configured to perform a contact/separation operation of the pair of nipping members, and the contact/separation mechanism separates the nipping members from each other until a leading edge of the sheet fed by the sheet feeding unit passes between the nipping members, and then relatively moves the pair of nipping members closer to each other to start the nipping of the sheet so the sheet is compressed.

9 Claims, 18 Drawing Sheets

(56) References Cited

U.S. PATENT DOCUMENTS

2012/0024124 A1* 2/2012 Mitsuhashi ..... 83/401
2012/0098190 A1 4/2012 Nieda et al.

FOREIGN PATENT DOCUMENTS

JP 2010-276846 A 12/2010
JP 2011-093626 A 5/2011

* cited by examiner

SHEET COMPRESSION APPARATUS AND IMAGE FORMING APPARATUS

BACKGROUND OF THE INVENTION

1. Field of the Invention

The present disclosure relates to a sheet compression apparatus configured to compress an edge of a sheet and an image forming apparatus including the sheet compression apparatus.

2. Description of the Related Art

An image forming apparatus employing an electrophotographic method forms an electrostatic latent image based on image information formed on a photosensitive drum as an image carrier, develops the electrostatic latent image, and visualizes the image as a toner image. The visualized toner image is transferred onto a sheet using electrostatic force and the transferred toner image is fixed to the sheet by applying heat. In this manner, an image is recorded on the sheet.

A toner image which has been formed but not yet fixed to the sheet is fixed to the sheet by applying heat and pressure by a fixing apparatus. As a fixing apparatus that fixes a toner image, a heat roller type fixing apparatus is used. The heat roller type fixing apparatus fixes the image transferred onto the sheet while the sheet is nipped at a nip portion formed by a pressure roller pressing a fixing roller which internally includes a heater.

More specifically, the fixing roller which is pressed by the pressure roller has an internal heat source such as a halogen heater and its temperature is maintained at a predetermined temperature. Further, the pressure roller that presses the fixing roller has elasticity. While the sheet conveyed to the heat roller type fixing apparatus is nipped at the fixing nip portion formed by these rollers, the unfixed toner image formed on the surface of the sheet is melted. Then, the image is fixed to the sheet surface.

The base material of the fixing roller is a metal such as aluminum. Further, an elastic layer is formed on the surface of the base material using, for example, silicon rubber. Additionally, the surface of the elastic layer is coated with fluorine resin as a non-adhesive layer. The fluorine resin aids in the separation of the fixing roller from the toner. The pressure, which is applied to the fixing roller by the pressure roller to form the fixing nip portion, is generated, for example, by a spring. A great deformation in the elastic layer and the non-adhesive layer of the fixing roller is generated when the nip portion is formed due to the pressure.

In recent years, with the increase in the media types, improved durability is required with respect to image forming apparatuses, such as copying machines and printers, capable of processing various types of media. Since the fixing roller and the pressure roller are damaged by fine chipping of the surface, surface layer flaking, and rough surface layer when thick paper passes between them, although the damage may be extremely light, it becomes noticeable when the rollers are used for along time and hampers the durability of the fixing apparatus.

Under such circumstances, Japanese Patent Application Laid-Open No. 2008-298925 discusses an image forming apparatus which is capable of reducing the fine chipping of the surface and surface layer flaking of the fixing roller and the pressure roller by reducing the thickness of the sheet by applying pressure to the sheet. According to the image forming apparatus discussed in Japanese Patent Application Laid-Open No. 2008-298925, the sheet conveyed to the fixing apparatus is made thinner by a compression apparatus arranged upstream of the fixing apparatus. Thus, the damage of the surface layer due to fine chipping and elongation of the elastic layer of the fixing roller and the pressure roller when thick paper passes the fixing apparatus can be reduced.

If the sheet is too thick, the leading edge of the sheet may not be nipped by the roller pair when the leading edge of the sheet is conveyed to the roller pair of the compression apparatus.

Although such a problem can be solved, for example, by increasing the diameter of the roller pair of the compression apparatus, if the diameter of the roller pair is increased, the whole apparatus will be larger. This is against the trend for downsizing. Further, if a metal roller pair is used, the apparatus will be heavier and handling will be more difficult.

SUMMARY OF THE INVENTION

The present disclosure is directed to a sheet compression apparatus useful for enhancing durability of a fixing roller and a pressure roller used for fixing an unfixed toner image onto a sheet without applying unnecessary load to a drive system, and an image forming apparatus including such a sheet compression apparatus.

According to an aspect disclosed herein, an image forming apparatus includes a sheet feeding unit configured to feed a sheet, an image forming unit configured to form an image on the sheet fed from the sheet feeding unit, and a sheet compression apparatus provided between the sheet feeding unit and the image forming unit and configured to compress the sheet fed by the sheet feeding unit before the image forming unit forms an image on the sheet. The sheet compression apparatus includes a pair of nipping members including two nipping members movable into contact with each other and being displaceable from the contact and compressing the sheet while the sheet is nipped, and a contact/separation mechanism configured to perform a contact/separation operation of the pair of nipping members, and a controlling portion configured to control so the contact/separation mechanism separates one of the nipping members from the other until a leading edge of the sheet fed by the sheet feeding unit passes between the nipping members and then moves the one of the first nipping members toward the other to start the nipping of the sheet such that the sheet is compressed.

Accordingly, by reducing the sheet thickness by applying pressure to the sheet when it is conveyed, durability of the fixing roller and the pressure roller used for fixing an unfixed toner image onto the sheet can be enhanced without applying an unnecessary load to the drive system.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the invention will be described in detail below with reference to the drawings.

An image forming apparatus including a sheet compression apparatus according to an exemplary embodiment of the present disclosure will now be described with reference to the drawings. The image forming apparatus according to the present exemplary embodiment is an image forming apparatus including a sheet compression apparatus which applies pressure to a sheet conveyed to the apparatus. The image forming apparatus is, for example, a copying machine, a printer, a fax machine, or a multifunction peripheral.

In the following exemplary embodiments described below, a tandem printer, which parallelly forms toner images of four colors, is used in the description. The present invention is applied not only to a full-color (four-color) intermediate transfer type image forming apparatus but also to a monochromatic image forming apparatus. Further, the color order is not limited to those of the exemplary embodiments described below.

Figure 1:
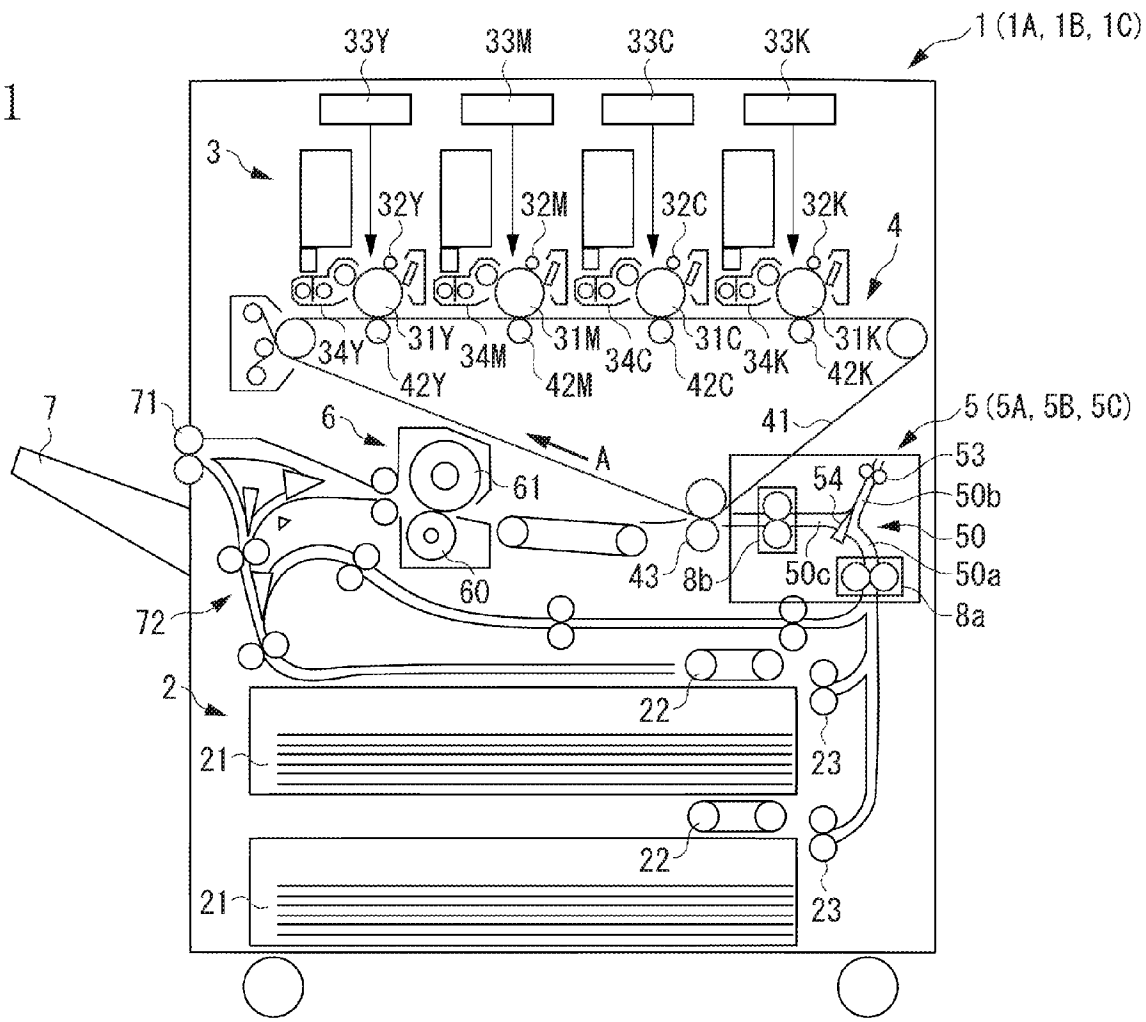
FIG. 1 illustrates a cross section of an entire structure of a printer according to an exemplary embodiment.

A printer 1 according to a first exemplary embodiment will now be described with reference to FIGS. 1 to 7B. First, the general structure of the printer 1 according to the first exemplary embodiment will be described with reference to FIG. 1. FIG. 1 is a cross section of the general structure of the printer 1 according to the present exemplary embodiment.

As illustrated in FIG. 1, the printer 1 according to the first exemplary embodiment includes a sheet feeding unit 2 which feeds a sheet S, an image forming unit 3 which forms an image, and a transfer unit 4 which transfers the image formed by the image forming unit 3 onto the sheet S. The printer 1 further includes a sheet compression apparatus 5 which compresses the sheet S to be conveyed to the transfer unit 4 by applying pressure, a fixing unit 6 which fixes the transferred image onto the sheet S, and a discharging unit 7 which discharges the sheet S on which an image is fixed. The image forming unit 3, the transfer unit 4, and the fixing unit 6 constitute an image forming unit of the printer 1 as a whole according to the present exemplary embodiment.

The sheet feeding unit 2 includes a feed cassette 21 where the sheet S is stored, a feed roller 22 which feeds the sheet S from the feed cassette 21, and a separation unit 23 which separates the sheet S one by one before the sheet S is fed by the feed roller 22.

The image forming unit 3 includes photosensitive drums 31Y, 31M, 31C, and 31K which form toner images of four colors (yellow (Y), magenta (M), cyan (C), and black (K)). Further, the image forming unit 3 includes primary charging devices 32Y, 32M, 32C, and 32K which uniformly charge the surfaces of the photosensitive drums 31Y to 31K, respectively.

Additionally, the image forming unit 3 includes exposure devices 33Y, 33M, 33C, and 33K which form electrostatic latent images on the photosensitive drums 31Y to 31K by irradiating thereof with a laser beam based on the image information. Further, the image forming unit 3 includes development units 34Y, 34M, 34C, and 34K each of which visualizes an electrostatic latent image formed on each of the photosensitive drums 31Y to 31K as a toner image.

The transfer unit 4 includes a transfer belt 41 which rotates in the direction of an arrow A illustrated in FIG. 1, transfer charging devices 42Y, 42M, 42C, and 42K, and a secondary transfer unit 43 which secondary transfers the toner image onto the sheet S. The transfer charging devices 42Y, 42M, 42C, and 42K transfer the toner image of each color on the photosensitive drums 31Y to 31K to the transfer belt 41.

The sheet compression apparatus 5, which is provided on a sheet conveyance path 50 that extends from the sheet feeding unit 2 to the secondary transfer unit 43 of the transfer unit 4, reduces the thickness of the sheet S by applying pressure to the sheet S fed from the sheet feeding unit 2. Details of the sheet compression apparatus 5 will be described below.

The fixing unit 6 includes a fixing roller 60 with a heater therein and a pressure roller 61 which presses the fixing roller 60. The fixing unit 6 applies heat and pressure to the sheet S onto which the toner image is transferred and fixes the toner image to the sheet S.

Next, an image forming job of the printer 1 according to the first exemplary embodiment will be described. When the image forming job of the printer 1 is started, based on image information output from a personal computer (not illustrated), laser beams are emitted from the exposure devices 33Y to 33K to the surfaces of the photosensitive drums 31Y to 31K.

Accordingly, the surfaces of the photosensitive drums 31Y to 31K, which are uniformly charged by predetermined polarity and potential, are sequentially exposed to the light and electrostatic latent images are formed on the surfaces of the photosensitive drums 31Y to 31K. The electrostatic latent images formed on the surfaces of the photosensitive drums 31Y to 31K are developed by the toner of the development units 34Y to 34K and visualized as toner images.

Then, the visualized toner images of the four colors reaches a primary transfer portion where each of the photosensitive drums 31Y to 31K contacts the transfer belt 41. At the primary transfer portion, the toner images are transferred (primary transfer) to the transfer belt 41 by a primary transfer bias applied to the transfer charging devices 42Y to 42K. Accordingly, a full-color (four-color) toner image is formed on the transfer belt 41.

In parallel with the forming operation of the toner image, the sheet S stored in the feed cassette 21 is separated from other sheets one by one by the separation unit 23 and fed by the feed roller 22. Then, the sheet S is conveyed to a registration roller (not illustrated) and further conveyed to the secondary transfer unit 43 at a predetermined timing by the registration roller.

When the sheet S passes through the sheet compression apparatus 5 provided on the sheet conveyance path 50, its thickness is reduced. The sheet compression operation of the sheet compression apparatus 5 will be described in detail below.

The toner image of four colors on the transfer belt 41 is transferred (secondary transfer) onto the sheet S whose thickness has been reduced by the sheet compression apparatus 5. The toner image is transferred in one operation according to a secondary transfer bias applied to the secondary transfer unit 43.

The sheet S onto which the toner image is transferred is conveyed from the secondary transfer unit 43 to the fixing unit 6. At the fixing unit 6, heat and pressure is applied to the sheet S and the toner is fused and mixed. As a result, a fixed full-color image is obtained. Then, the sheet S having the fixed image is discharged to the discharging unit 7 by a discharge roller pair 71 provided downstream of the fixing unit 6, and the image forming job ends.

If the sheet S is to have images formed on both sides, after the unfixed toner image is fixed to the sheet S by the fixing unit 6, before the sheet S is discharged to the discharging unit 7 by the discharge roller pair 71, the rotation of the discharge roller pair 71 is reversed. In this manner, the sheet S is conveyed to a two-sided conveyance path 72. The sheet S conveyed to the two-sided conveyance path 72 is conveyed again to the image forming unit 3 by, for example, a skewed roller pair and a U-turn roller pair. Accordingly, the two-sided printing is performed.

Next, the sheet compression apparatus 5 according to the first exemplary embodiment will be described with reference to FIGS. 2A to 7 as well as FIG. 1. First, the configuration of the sheet compression apparatus 5 will be described with reference to FIGS. 1 to 4.

Figure 2A:
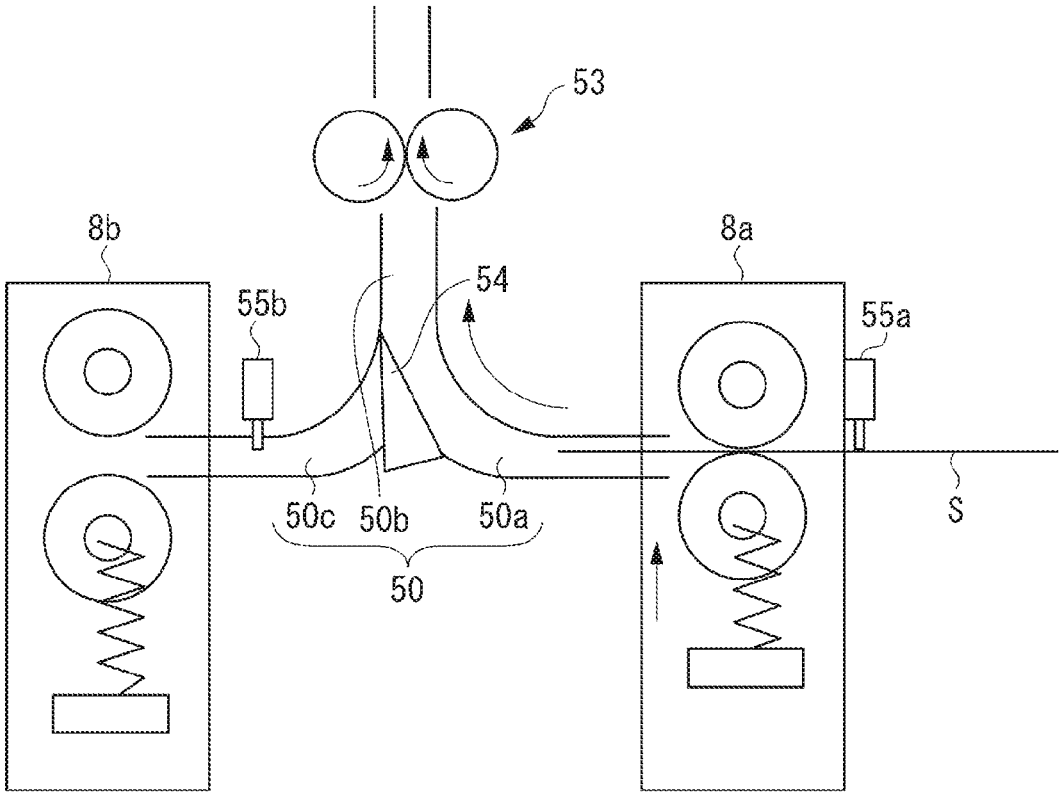
FIG. 2A schematically illustrates a state where a sheet compression apparatus compresses a trailing edge of a sheet according to a first exemplary embodiment.
Figure 2B:
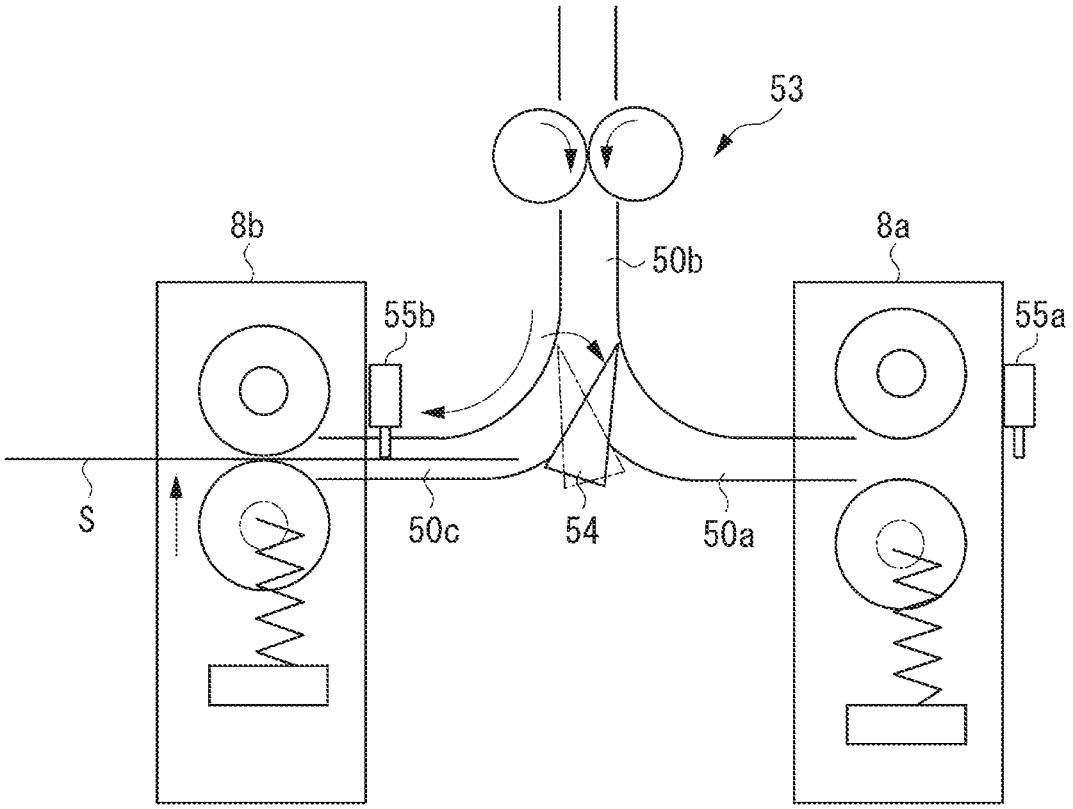
FIG. 2B schematically illustrates a state where the sheet compression apparatus compresses a leading edge of the sheet according to the first exemplary embodiment.

FIG. 2A schematically illustrates a state where the sheet compression apparatus 5 compresses a trailing edge of the sheet S according to the first exemplary embodiment. FIG. 2B schematically illustrates a state where the sheet compression apparatus 5 compresses the leading edge of the sheet S according to the first exemplary embodiment.

Figure 3A:
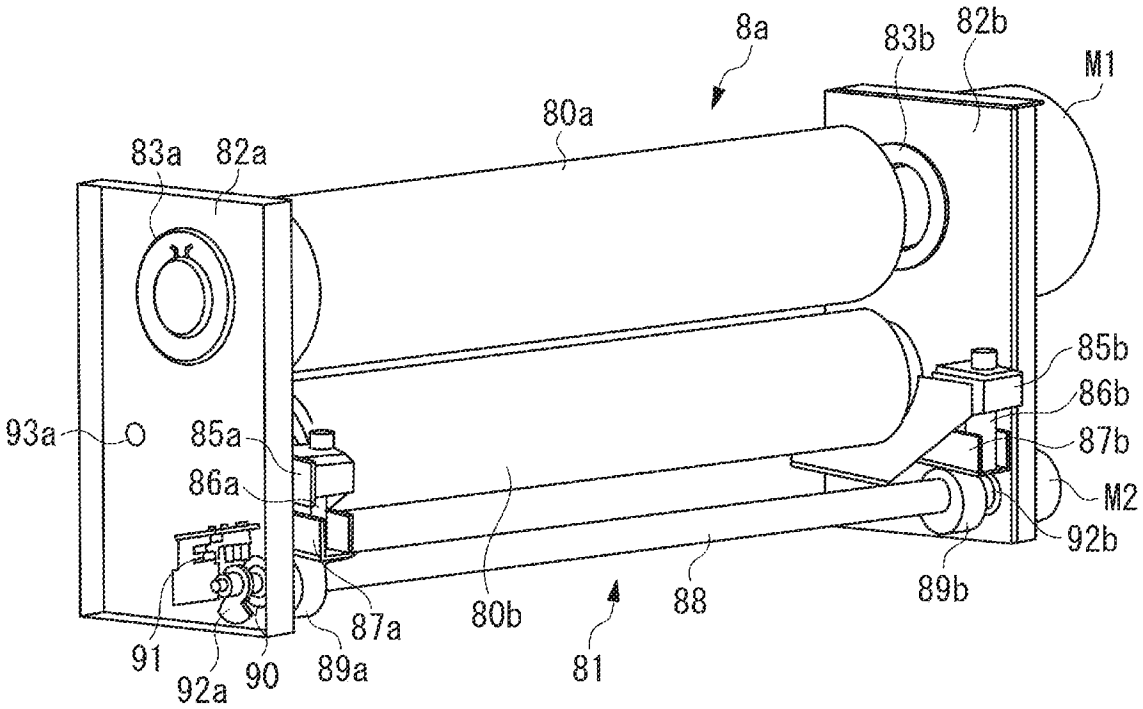
FIG. 3A is a perspective view of a first pressure application unit according to the first exemplary embodiment.
Figure 3B:
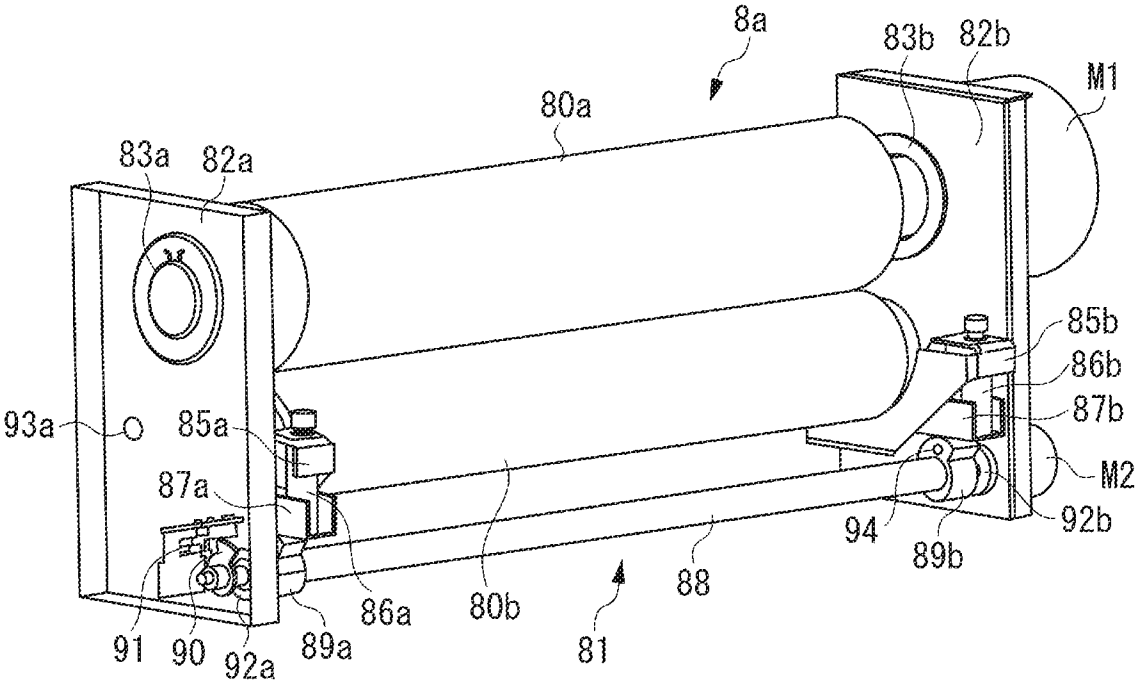
FIG. 3B is a perspective view of the first pressure application unit in a state where a metal roller is moved toward the other metal roller.

FIG. 3A is a perspective view of a first pressure application unit 8*a* according to the first exemplary embodiment. FIG. 3B is a perspective view of the first pressure application unit 8*a* in a state where a metal roller is moved closer to the other metal roller.

Figure 4:
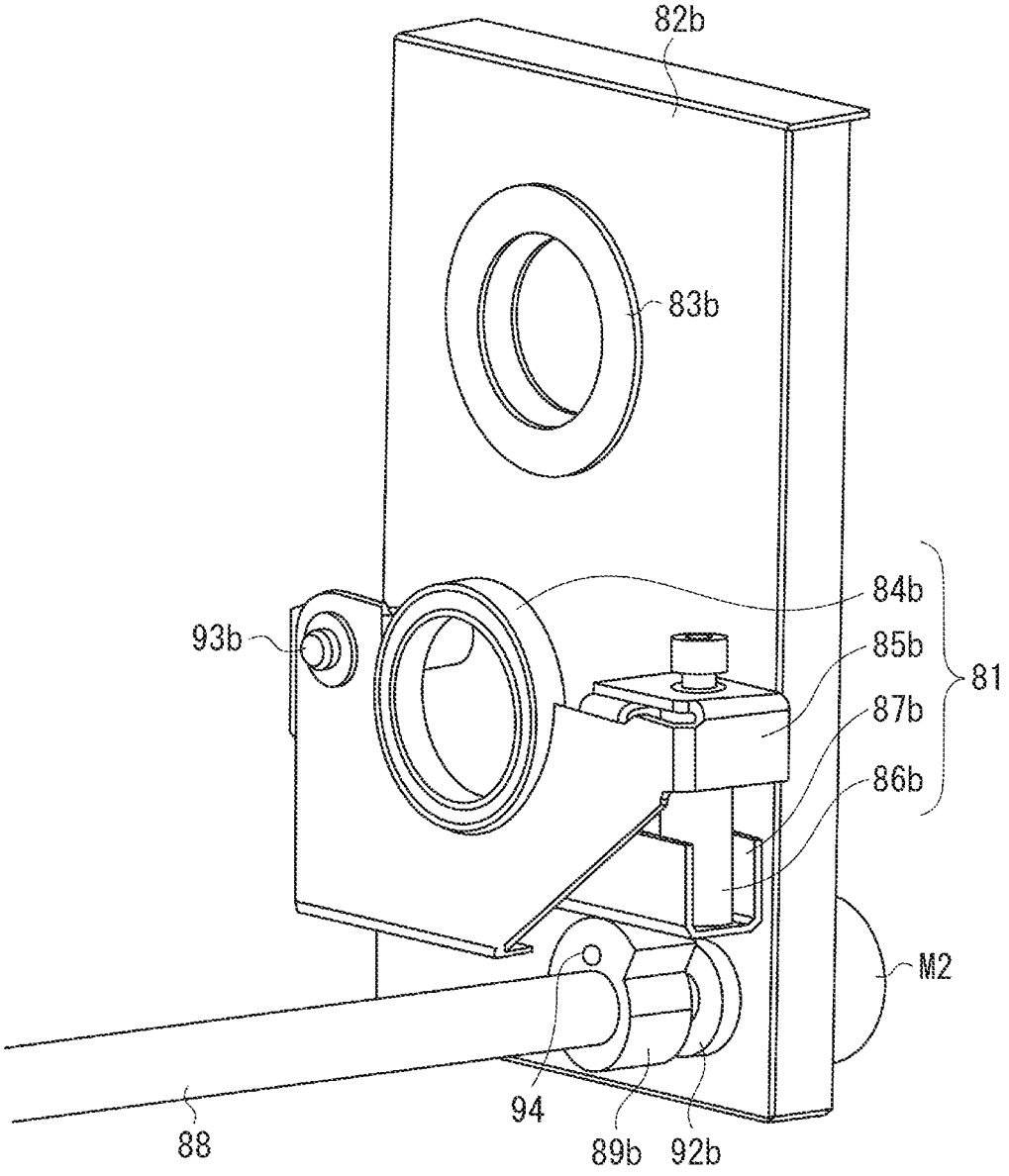
FIG. 4 is a perspective view of a portion of a roller contact/separation mechanism of the first pressure application unit according to the first exemplary embodiment.

FIG. 4 is a perspective view of a portion of a roller contact/separation mechanism of the first pressure application unit 8*a* according to the first exemplary embodiment.

As illustrated in FIGS. 1 to 2B, the sheet compression apparatus 5 includes the first pressure application unit 8*a* and a second pressure application unit 8*b*. The first pressure application unit 8*a* is a first pressure application unit of a pressure application unit and applies pressure to a trailing edge as a second edge of the sheet S. The second pressure application unit 8*b* is a second pressure application unit of the pressure application unit and applies pressure to a leading edge as a first edge of the sheet S.

The first pressure application unit 8*a* is a first nipping unit that compresses the sheet while the sheet is nipped and conveyed. The second pressure application unit 8*b* is a second nipping unit that compresses the sheet while the sheet is nipped and conveyed.

The sheet compression apparatus 5 further includes a reversing conveyance roller pair 53, a flapper 54, and leading edge detection sensors 55*a* and 55*b*. The reversing conveyance roller pair 53 is a conveyance switching unit that changes the top end of the sheet S whose trailing edge has been compressed by pressure. The reversing conveyance roller pair 53 is a pair of rotating bodies that rotates in the positive and negative directions. The leading edge detection sensors 55*a* and 55*b* detect the leading edge position of the sheet S.

The first pressure application unit 8*a* is arranged on a first conveyance path 50*a* of the sheet conveyance path 50, and the reversing conveyance roller pair 53 is arranged on a second conveyance path 50*b* which is connected to the first conveyance path 50*a* of the sheet conveyance path 50. The second pressure application unit 8*b* is arranged on a third conveyance path 50*c* of sheet conveyance path 50 which is branched from the connecting portion of the first conveyance path 50*a* and the second conveyance path 50*b* toward the secondary transfer unit 43.

Since the configuration of the second pressure application unit 8*b* provided downstream of the first pressure application unit 8*a* is the same as the configuration of the first pressure application unit 8*a*, only the configuration of the first pressure application unit 8*a* is described in the following description. The components of the second pressure application unit 8*b* are denoted by the same reference numerals and their descriptions are not repeated.

As illustrated in FIGS. 3A, 3B, and 4, the first pressure application unit 8*a* includes a pair of nipping members and a roller separation mechanism 81. The pair of nipping members is a metal roller pair (metal rollers 80*a* and 80*b*) as a first nipping member and a second nipping member. The roller separation mechanism 81 is a first contact/separation mechanism (a second contact/separation mechanism) of a contact/separation mechanism.

The metal roller 80*a* is supported by a pair of side plates (side plates 82*a* and 82*b*) in a rotatable manner. To be more precise, bearings 83*a* and 83*b* are fixed to the ends of the metal roller 80*a*, and the metal roller 80*a* is rotatably supported by the side plates 82*a* and 82*b* via the bearings 83*a* and 83*b*. The axis of rotation of the metal roller 80*a* is a direction perpendicular to the sheet conveying direction with respect to the first conveyance path 50*a*.

Further, a metal roller drive motor M1 is connected to one end of the metal roller 80*a* via a gear (not illustrated). The metal roller drive motor M1 is fixed to the side plate 82*b*.

The metal roller 80*b* is supported by the roller separation mechanism 81 in a rotatable manner and in parallel with the axis of rotation of the metal roller 80*a*. The diameter of the metal rollers 80*a* and 80*b* according to the present exemplary embodiment is 33 mm, and the metal rollers are formed by stainless steel so that deformation is small even if the application of pressure is increased. The pressure is applied to the sheet S by the nipping of the metal rollers 80*a* and 80*b*.

The roller separation mechanism 81 includes pressure application plates 85*a* and 85*b* and cam contact plates 87*a* and 87*b*. The metal roller 80*b* is rotatably supported by the pressure application plates 85*a* and 85*b* via bearings 84*a* and 84*b*. The cam contact plates 87*a* and 87*b* are connected to the pressure application plates 85*a* and 85*b* via pressure application springs 86*a* and 86*b*.

Further, the roller separation mechanism 81 includes rocking cams 89*a* and 89*b* which serve as pressure application adjustment devices, a cam flag 90 which is provided at one end of the cam shaft 88, and a cam sensor 91 which detects the position of the cam flag 90. The rocking cams 89*a* and 89*b* are provided at both ends of the cam shaft 88, respectively.

The cam contact plates 87*a* and 87*b* are rotatably supported by the side plates 82*a* and 82*b*. The supporting points of the cam contact plates 87*a* and 87*b* are hinge shafts 93*a* and 93*b* fixed to the side plates 82*a* and 82*b*. The pressure application plates 85*a* and 85*b* are moved according to the cam contact plates 87*a* and 87*b* rotating about the shafts 93*a* and 93*b*. Thus, according to the rotation of the cam contact plates 87*a* and 87*b*, the metal roller 80*b*, whose ends are supported by the pressure application plates 85*a* and 85*b*, moves up and down. The metal roller 80*b* is arranged in such a manner that it can contact the metal roller 80*a* and also be separated from the metal roller 80*a*.

The cam shaft 88 is rotatably supported by the side plates 82*a* and 82*b* via bearing 92*a* and 92*b*. The rocking cams 89*a* and 89*b* are attached to the ends of the cam shaft 88, and the cam flag 90 is fixed to one end of the cam shaft 88. Further, the cam shaft 88 is connected to a cam drive motor M2. The cam drive motor M2 is fixed to the side plate 82*b*.

The rocking cams 89*a* and 89*b* have a same shape and are fixed to the ends of the cam shaft 88 in the same phase. Further, the rocking cams 89*a* and 89*b* contact the cam contact plates 87*a* and 87*b*. When the rocking cams 89*a* and 89*b* are moved to a top dead center 94 at the top portion as illustrated in FIG. 4, the rocking cams 89*a* and 89*b* raise the cam contact plates 87*a* and 87*b*. The cam contact plates 87*a* and 87*b* raised by the rocking cams 89*a* and 89*b* compress the pressure springs 86*a* and 86*b*, and the pressure springs 86*a* and 86*b* raise the pressure application plates 85*a* and 85*b*. As a result, the metal roller 80*b* is raised.

The cam flag 90 blocks the light that passes through a detection slit of the cam sensor 91 when the rocking cams 89*a* and 89*b* are at the top dead center 94 at the top portion illustrated in FIG. 4. When the rocking cams 89*a* and 89*b* rotate and move from the top dead center 94, the light passes through the detection slit again. Thus, the position of the cam flag 90 is detected by the cam sensor 91 detecting the presence/absence of the light that passes through the detection slit. According to the present exemplary embodiment, a photointerrupter is used for the cam sensor 91.

The reversing conveyance roller pair 53 is provided on the second conveyance path 50*b*, and the flapper 54 is provided at a connection portion of the first conveyance path 50*a* and the second conveyance path 50*b*. If the conveyance of the sheet S to the third conveyance path 50*c* is regulated by the flapper 54, the top end of the sheet S conveyed from the first conveyance path 50*a* to the second conveyance path 50*b* is changed from the leading edge to the trailing edge by the reversing conveyance roller pair 53.

More specifically, the reversing conveyance roller pair 53 rotates in normal rotation direction until the trailing edge of the sheet S having the leading edge of the sheet as the top end in the conveying direction passes the flapper 54. When the trailing edge passes the flapper 54, the reversing conveyance roller pair 53 moves in the reverse rotation direction and the sheet S is conveyed to the flapper 54 having the trailing edge of the sheet as the top end in the conveying direction. When the reversing conveyance roller pair 53 rotates in the reverse rotation direction, the flapper 54 regulates the sheet S from being conveyed to the first conveyance path 50*a*. As a result, the sheet S is conveyed to the third conveyance path 50*c* branched to the secondary transfer unit 43.

The leading edge detection sensors 55*a* and 55*b* detect the leading edge position of the sheet S. More specifically, the leading edge detection sensor 55*a*, which is provided upstream of the first pressure application unit 8*a*, detects the leading edge position of the sheet S when the sheet is conveyed to the first pressure application unit 8*a*.

Further, the leading edge detection sensor 55*b* is provided upstream of the second pressure application unit 8*b* and detects the top end of the sheet S when the sheet is conveyed to the third conveyance path 50*c* by the flapper 54. The top end of the sheet S in this case is the trailing edge of the sheet.

Figures 6, 6A, 6B:
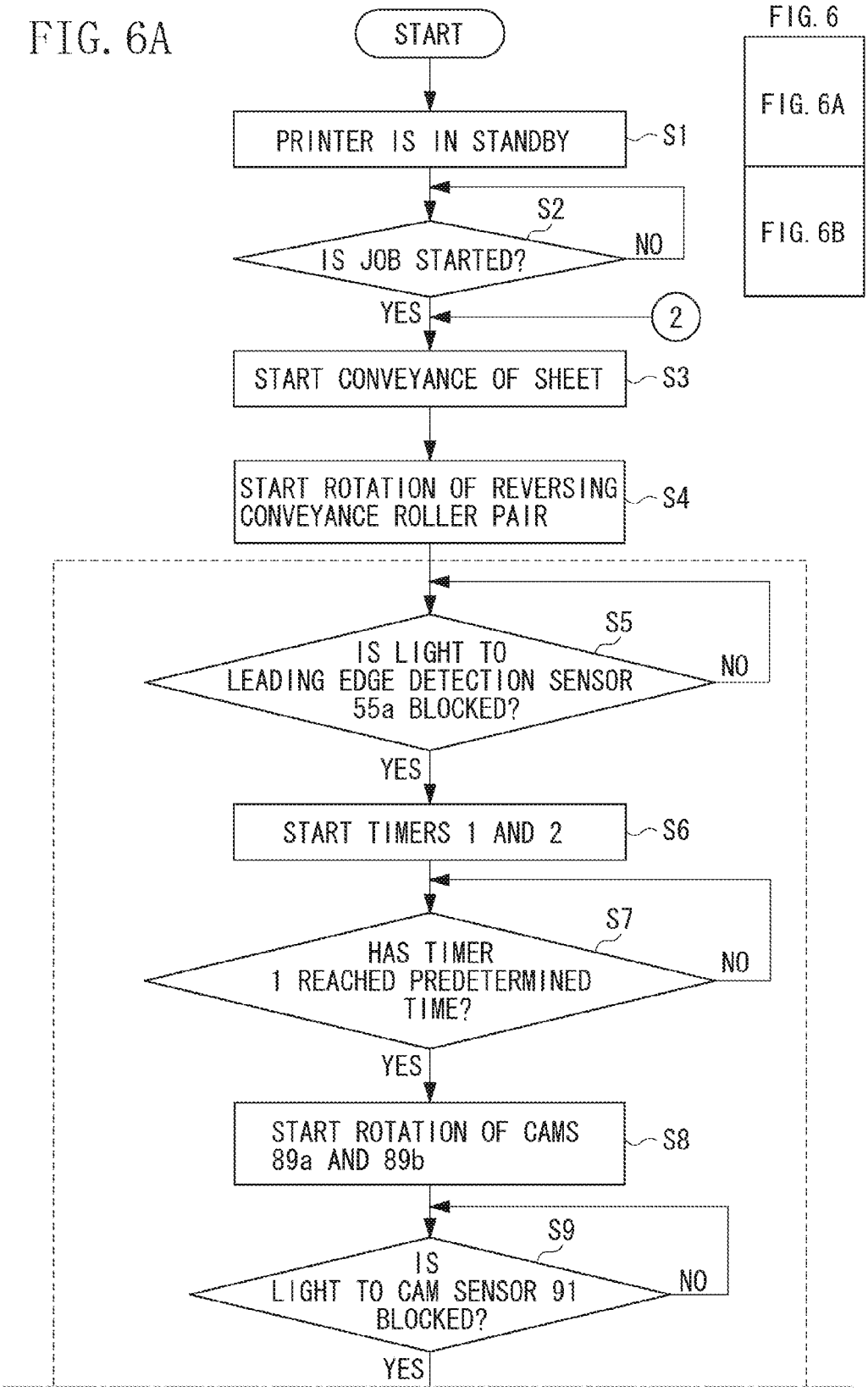
FIGS. 6A and 6B (6A+6B) are a flowchart illustrating a sheet compression control operation performed by the sheet compression control unit.
Figure 6B:
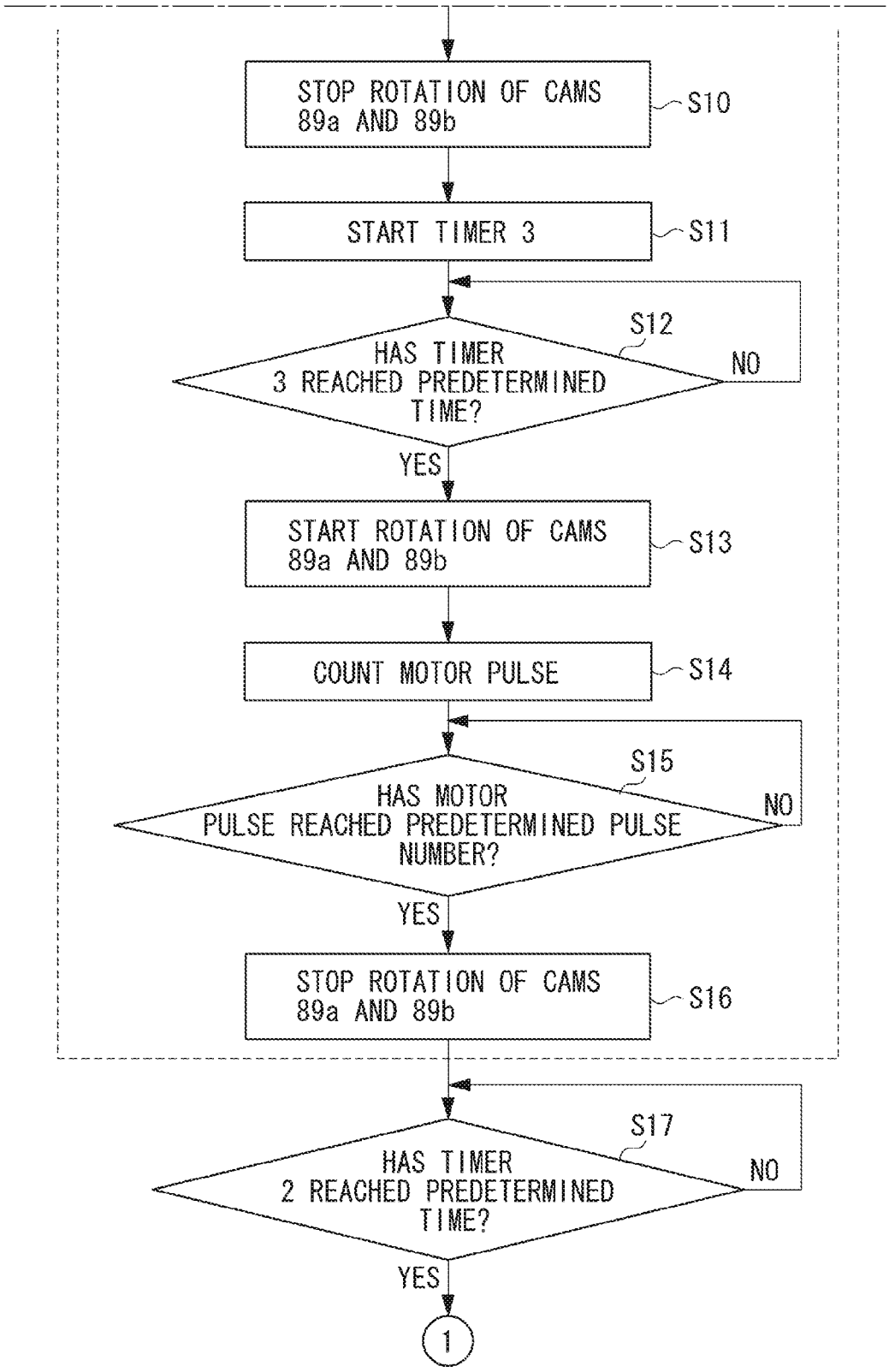
Figure 7:
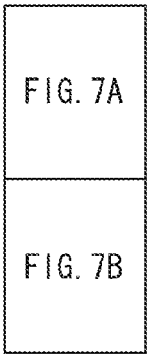
FIGS. 7A and 7B are a flowchart illustrating a sheet compression control operation performed by the sheet compression control unit.
Figure 7A:
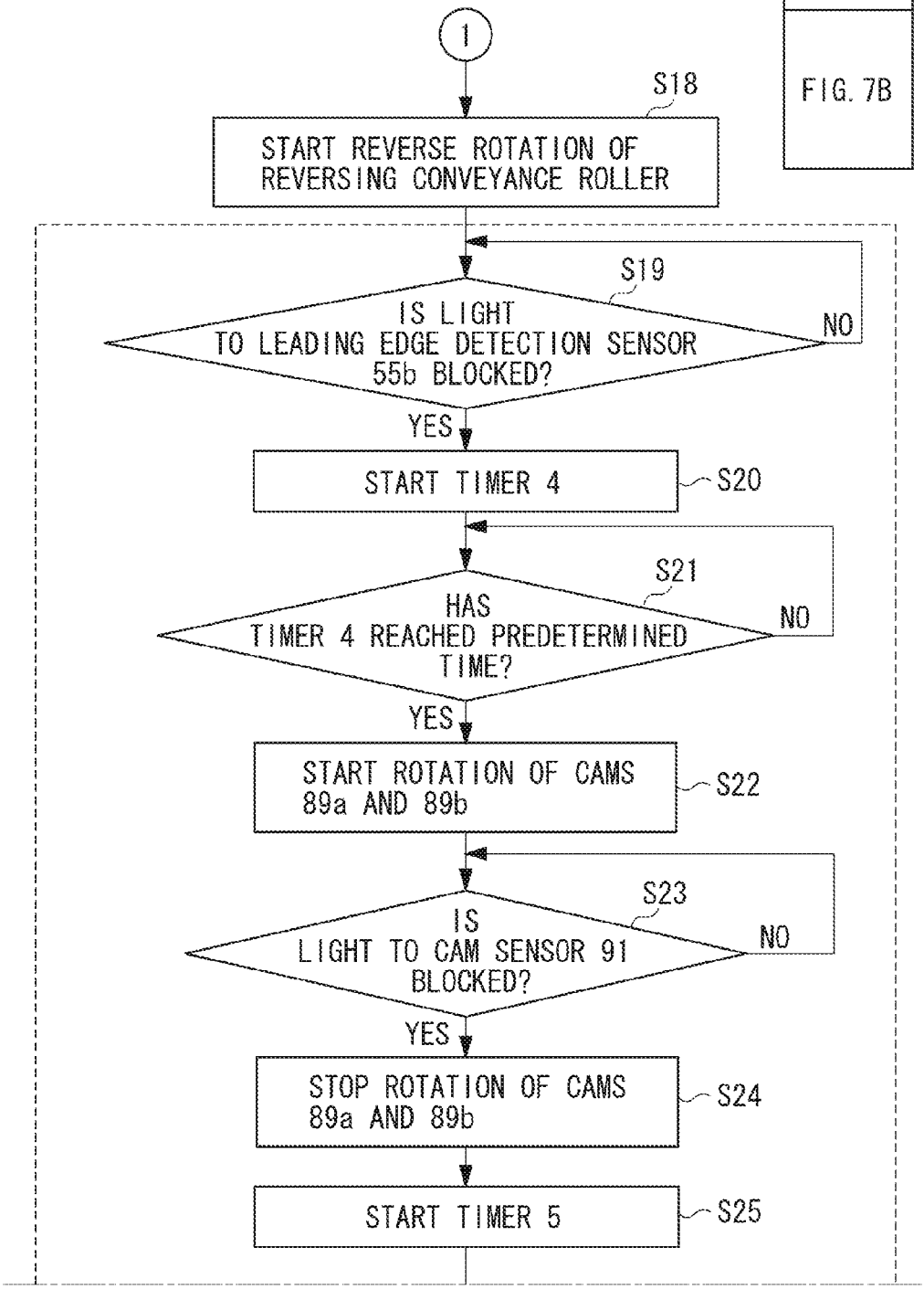
Figure 7B:
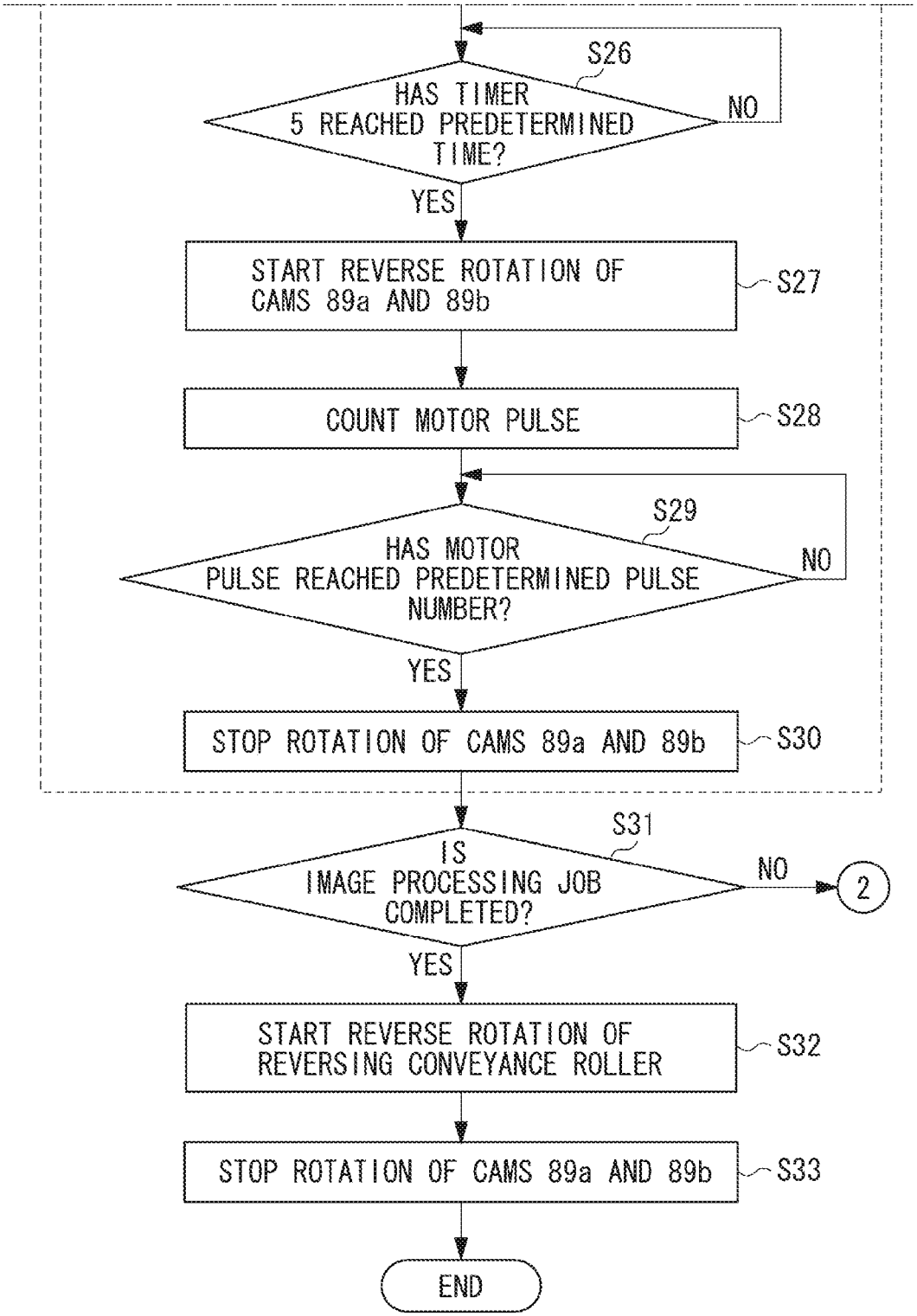

Next, a sheet compression control unit 11 included in a control unit 10 of the printer 1 will be described with reference to FIGS. 5 to 7 (7A+7B). The sheet compression control unit 11 controls the sheet compression apparatus 5.

Figure 5:
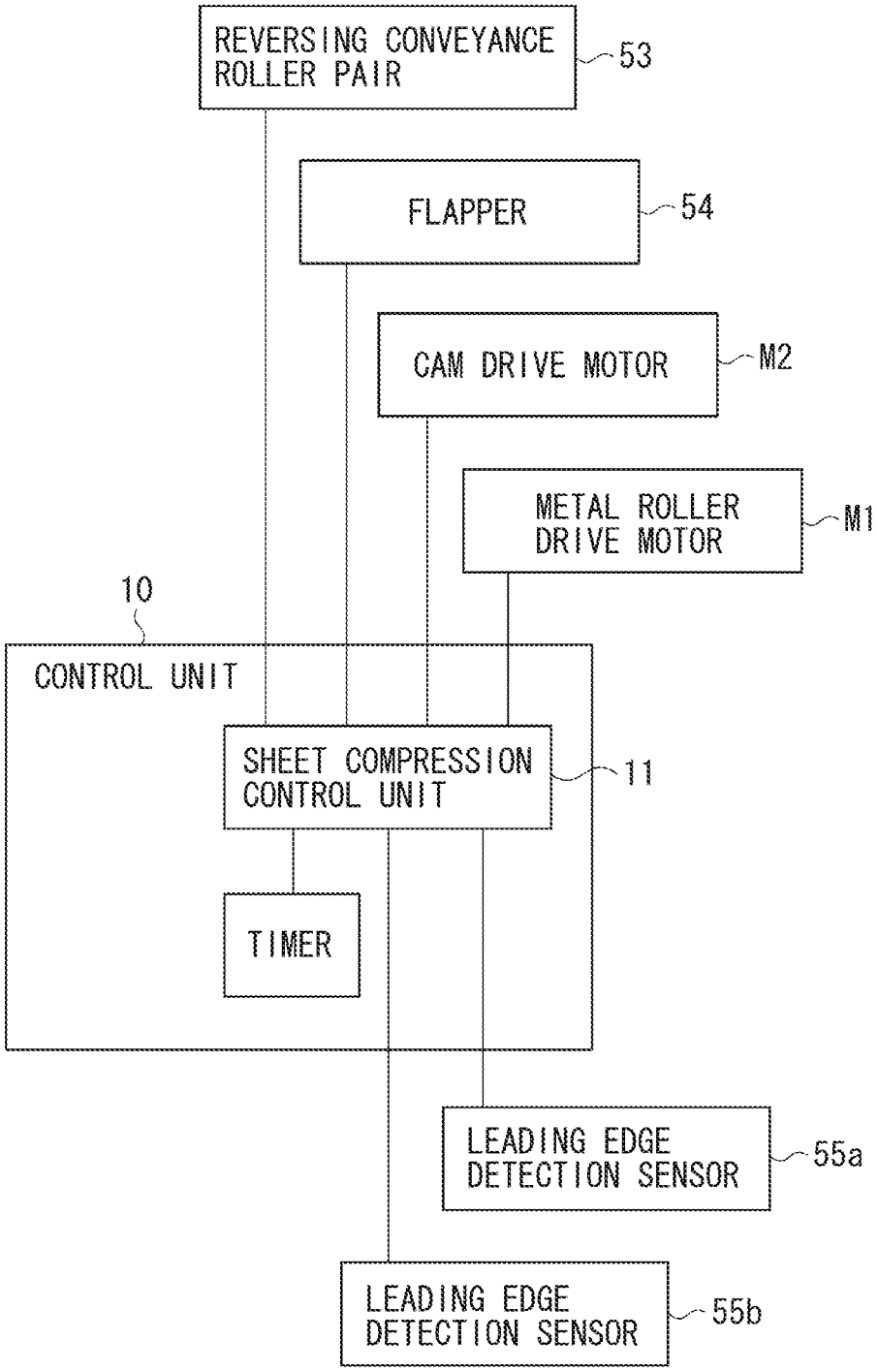
FIG. 5 is a block diagram of a sheet compression control unit according to the first exemplary embodiment.

FIG. 5 is a block diagram of the sheet compression control unit 11 according to the first exemplary embodiment. FIGS. 6 (6A+6B) and 7 (7A+7B) are flowcharts illustrating the sheet compression control operation performed by the sheet compression control unit 11.

As illustrated in FIG. 5, the sheet compression control unit 11 is electrically connected to the leading edge detection sensors 55*a* and 55*b*, the metal roller drive motor M1, the cam drive motor M2, the reversing conveyance roller pair 53, and the flapper 54. When the leading edge detection sensor 55*a* or 55*b* detects the top end of the sheet in the conveying direction (the leading edge or the trailing edge of the sheet), the sheet compression control unit 11 drives the metal roller drive motor M1, the cam drive motor M2, the reversing conveyance roller pair 53, and the flapper 54 based on the result of the detection.

Further, the sheet compression control unit 11 includes a plurality of timers. When the top end of the sheet S in the conveying direction is detected by the leading edge detection sensor 55*a* or 55*b*, the sheet compression control unit 11 drives the metal roller drive motor M1 and the cam drive motor M2 at predetermined timing according to each timer.

The sheet compression job performed by the sheet compression apparatus 5 and controlled by the sheet compression control unit 11 will be described with reference to FIGS. 6 and 7.

In step S1, the printer 1 is in the standby state. In step S2, whether the job (the sheet compression job and the image forming job) is started is determined. If the job is started (YES in step S2), the processing proceeds to step S3. In step S3, the sheet S is fed from the feed cassette 21 and the conveyance of the sheet S is started.

In step S4, the sheet compression control unit 11 drives the metal roller drive motor M1 so that the rotation of the metal roller 80*a* is started, and the rotation of the reversing conveyance roller pair 53 is also started. In step S5, the sheet compression control unit 11 determines whether the light to the leading edge detection sensor 55*a* is blocked by the leading edge of the sheet S. If the light to the leading edge detection sensor 55*a* is blocked (YES in step S5), the leading edge position of the sheet S is detected and the sheet compression control unit 11 drives the flapper 54 so that the sheet S is conveyed from the first conveyance path 50*a* to the second conveyance path 50*b*. Then, the processing proceeds to step S6.

Further, since the leading edge detection sensor 55*a* is separated a predetermined distance from the first pressure application unit 8*a*, the leading edge of the sheet S passes between the metal rollers 80*a* and 80*b* at a time after the leading edge of the sheet S is detected by the leading edge detection sensor 55*a*. In step S6, the sheet compression control unit 11 sets a first predetermined time for a timer 1 and counts the time. The fist predetermined time is from when the leading edge of the sheet S is detected by the leading edge detection sensor 55*a* until the leading edge of the sheet S passes between the metal rollers 80*a* and 80*b* of the first pressure application unit 8*a*.

Simultaneously, in step S6, the sheet compression control unit 11 sets a second predetermined time for a timer 2. The second predetermined period of time is the time until the reverse rotation of the reversing conveyance roller pair 53 for the switchback operation is started.

In step S7, the sheet compression control unit 11 determines whether the count of the timer 1 has reached the first predetermined time (defined count). If the timer 1 has reached the first predetermined time (YES in step S7), the processing proceeds to step S8. In step S8, the sheet compression control unit 11 controls the cam drive motor M2 to rotate the rocking cams 89*a* and 89*b*. When the rocking cams 89*a* and 89*b* rotate, they raise the cam contact plates 87*a* and 87*b* which are connected to the pressure application plates 85*a* and 85*b*. Accordingly, the metal roller 80*b* supported by the pressure application plates 85*a* and 85*b* is raised, and the metal roller 80*b* moves closer to the metal roller 80*a*.

In step S9, the sheet compression control unit 11 determines whether the light that passes through the detection slit of the cam sensor 91 is blocked by the cam flag 90. If the light is blocked (YES in step S9), the processing proceeds to step S10. In step S10, the sheet compression control unit 11 stops the drive of the cam drive motor M2 so that the rotation of the rocking cams 89*a* and 89*b* is stopped. According to the above-described processing, the distance between the metal rollers 80*a* and 80*b*, which is separated to allow the sheet S to pass, is reduced, and pressure is applied to the trailing edge of the sheet S while the sheet S is conveyed between the metal rollers 80*a* and 80*b*.

The rocking cams 89*a* and 89*b* are formed in such a manner that the cam faces that raise the metal roller 80*b* move to the top dead center 94 gradually. Thus, the pressure applied to the sheet S by the metal rollers 80*a* and 80*b* gradually increases.

Further, by adjusting the amount of rotation of the rocking cams 89*a* and 89*b*, the application of pressure can be stopped at timing of a predetermined pressure force (pressure force with respect to the metal roller 80*a*). Thus, the application of pressure can be adjusted by the amount of rotation of the rocking cams 89*a* and 89*b*.

For example, when the metal rollers 80*a* and 80*b* are in a contact state at standby, if the amount of pressure applied to the metal roller 80*a* until the leading edge passes the rollers is set as a first pressure amount P1 and the amount of pressure applied to the metal roller 80*a* after the leading edge has passed the rollers is set as a second pressure amount P2, the pressure amount can be set as P1<P2.

In step S11, if the cam flag 90 blocks the light to the detection slit of the cam sensor 91, the sheet compression control unit 11 sets a third predetermined time for a timer 3. The third predetermined time is the time until the trailing edge of the sheet S passes between the metal rollers 80*a* and 80*b* of the first pressure application unit 8*a*.

In step S12, the sheet compression control unit 11 determines whether the count of the timer 3 has reached the third predetermined time (defined count). If the timer 3 has reached the third predetermined time (YES in step S12), the processing proceeds to step S13. In step S13, the sheet compression control unit 11 drives the cam drive motor M2 so that the rocking cams 89*a* and 89*b* rotate in the reverse rotation direction. Accordingly, the metal roller 80*b* is separated from the metal roller 80*a*.

In step S14, the sheet compression control unit 11 starts counting the pulse number (motor pulse) of the cam drive motor M2. In step S15, the sheet compression control unit 11 determines whether the pulse number has reached a defined pulse. If the pulse number has reached a defined pulse (YES in step S15), the processing proceeds to step S16. In step S16, the sheet compression control unit 11 stops the drive of the cam drive motor M2 and stops the rotation of the rocking cams 89*a* and 89*b* in the reverse direction. In other words, the sheet compression control unit 11 stops the movement of the metal roller 80*b*.

In step S17, the sheet compression control unit 11 determines whether the count of the timer 2 has reached the second predetermined time (defined count). If the timer 2 has reached the second predetermined time (YES in step S17), the processing proceeds to step In step S18, the sheet compression control unit 11 drives the metal roller drive motor M1 so that the reversing conveyance roller pair 53 rotates in the reverse direction. Since the direction in which the sheet S is conveyed is changed, the top end of the sheet S is also changed. In this manner, the sheet S is conveyed to the third conveyance path 50*c* having the trailing edge of the sheet S as the top end of the sheet in the conveying direction.

At this time, the sheet compression control unit 11 controls the flapper 54 so that the conveyance of the sheet S to the first conveyance path 50*a* is regulated and the sheet S is conveyed from the second conveyance path 50*b* to the third conveyance path 50*c*.

In step S19, the sheet compression control unit 11 determines whether the light to the leading edge detection sensor 55*b* is blocked by the trailing edge of the sheet S. If the light is blocked (YES in step S19), the leading edge position of the sheet S is detected, and the processing proceeds to step S20. In steps S20 to S30, the sheet compression control unit 11 performs operations similar to those performed for the first pressure application unit 8*a* described above for the second pressure application unit 8*b*. Accordingly, by the second pressure application unit 8*b*, pressure is applied to the trailing edge of the sheet, which is the portion of the sheet S where pressure is not yet applied to, by processing similar to what has been described above.

Since the operations of the second pressure application unit 8*b* in steps S20 to S30 are similar to those performed in step S6 to S16 with respect to the first pressure application unit 8*a* described above, their descriptions are not repeated.

When the pressure application to the trailing edge of the sheet S (pressure unapplied portion) by the second pressure application unit 8*b* ends (the pressure application processing of the whole sheet S ends), the above-described image forming job is performed. In step S31, whether the image forming job is completed is determined. If the image forming job is completed (YES in step S31), the processing proceeds to step S32. In steps S32 and S33, the rotation of the reversing conveyance roller pair 53 is stopped and the job ends.

In this manner, with the printer 1 according to the first exemplary embodiment, pressure is applied to the trailing edge of the sheet S while the sheet S passes through the first pressure application unit 8*a*. Then, after the top end of the sheet S in the conveying direction is changed by the reversing conveyance roller pair 53, pressure is applied to the leading edge of the sheet S (the pressure unapplied portion) by the second pressure application unit 8*b*. In other words, when either the first or the second edge of the sheet passes the edge detection sensor, application of pressure is started and pressure is applied to the other edge of the sheet.

Thus, even if the sheet S is thick, since the thickness is reduced by the sheet compression apparatus 5, the increase in the drive load to the drive system when the sheet passes can be reduced.

In this manner, it is not necessary to increase the load torque of the drive motor and the possibility of the stepping-out of the drive motor is reduced. Further, since the load on the drive train such as a gear can be restrained, damage of the gear can be prevented.

Further, since the thickness of the sheet can be reduced without increasing the roller diameter, downsizing of the whole apparatus is not interrupted. As a result, possibility of the chipping of the fixing roller 60 and the pressure roller 61 of the fixing unit 6 can be easily reduced and durability of the fixing roller 60, and the pressure roller 61 can be enhanced.

Figure 8:
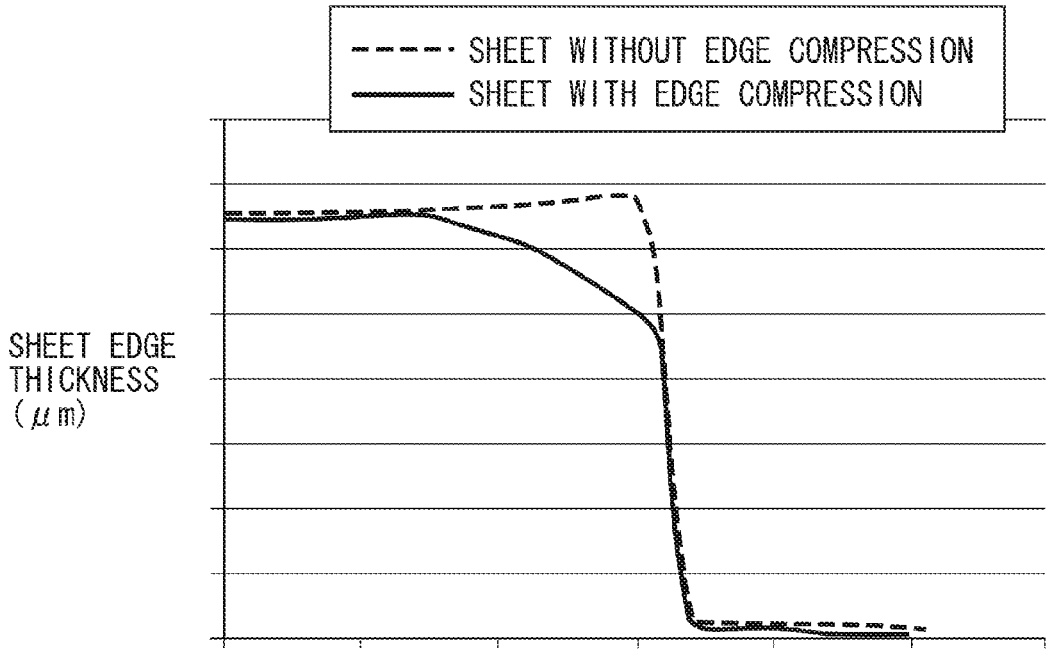
FIG. 8 illustrates a change in thickness of a sheet when the sheet is fed through the sheet compression apparatus.

FIG. 8 illustrates the change in the thickness of the sheet S when it is conveyed through the sheet compression apparatus 5 according to the first exemplary embodiment.

The sheet S conveyed to the sheet compression apparatus 5 is an A4-size sheet of i-best-W of Nippon Daishowa Paperboard Co., Ltd. with a grammage of 310 (gsm) and a thickness of 340 (μm). The sheet S is fed so that the widthwise direction is parallel to the sheet conveying direction (so-called A4R paper feeding). Further, each of the metal rollers 80*a* and 80*b* is a stainless steel roller with a diameter of 33 mm. A pressure of 450 (kg) is applied and the linear pressure applied to the sheet S with the width of A4R is 21.4 (kgf/cm). The conveying speed of the metal roller pair is set to 300 (mm/s).

As illustrated in FIG. 8, the edge thickness of the sheet S before it is conveyed to the sheet compression apparatus 5 is 340 (μm). After the sheet S is conveyed through the apparatus, the edge thickness is reduced by 90 (μm) to 250 (μm). Further, burrs at the sheet edge is reduced from 7.4 (μm) to 1.6 (μm). From this result, it is understood that the generation of rough and chipped surface layers of the fixing roller 60 and the pressure roller 61 of the fixing unit 6 can be reduced.

For example, if a sheet with a thickness of 340 (μm) is conveyed to the fixing unit without using the sheet compression apparatus 5, the surface of the fixing roller will be rough and a linear line may be formed on the image by a single pass of one sheet. However, by using the sheet compression apparatus 5, a sheet having the thickness reduced to 250 (μm) can be conveyed to the fixing unit. In this case, a linear line is not formed on the first sheet. Accordingly, durability thereof is enhanced.

Thus, it is understood that compressing the sheet edges (at least the leading edge and the trailing edge in the sheet conveying direction) by the metal roller pair is effective in reducing the damage to the fixing roller and the pressure roller of the fixing unit due to the passing of the sheet.

Further, by using the sheet compression apparatus 5 according to the present exemplary embodiment, the damage of the drive motor and the drive gear due to a rapid increase in the drive load that occurs when the leading edge of the sheet enters the metal roller pair can be prevented. Further, without increasing the roller diameter, a sheet with a thickness of 300 (μm) or more can pass through the metal roller pair.

Next, an image forming apparatus 1A according to a second exemplary embodiment of the present invention will be described with reference to FIGS. 9A and 9B as well as FIG. 1.

The image forming apparatus 1A according to the second exemplary embodiment is different from the image forming apparatus according to the first exemplary embodiment in that the position of the second pressure application unit 8*b* of the sheet compression apparatus 5 is different. Thus, according to the second exemplary embodiment, the points different from the first exemplary embodiment, in other words, the position of the second pressure application unit 8*b* is mainly described. Components similar to those of the first exemplary embodiment are denoted by the same reference numerals and their descriptions are not repeated. According to the second exemplary embodiment, the components similar to those of the first exemplary embodiment produce effects similar to those of the first exemplary embodiment.

Figure 9A:
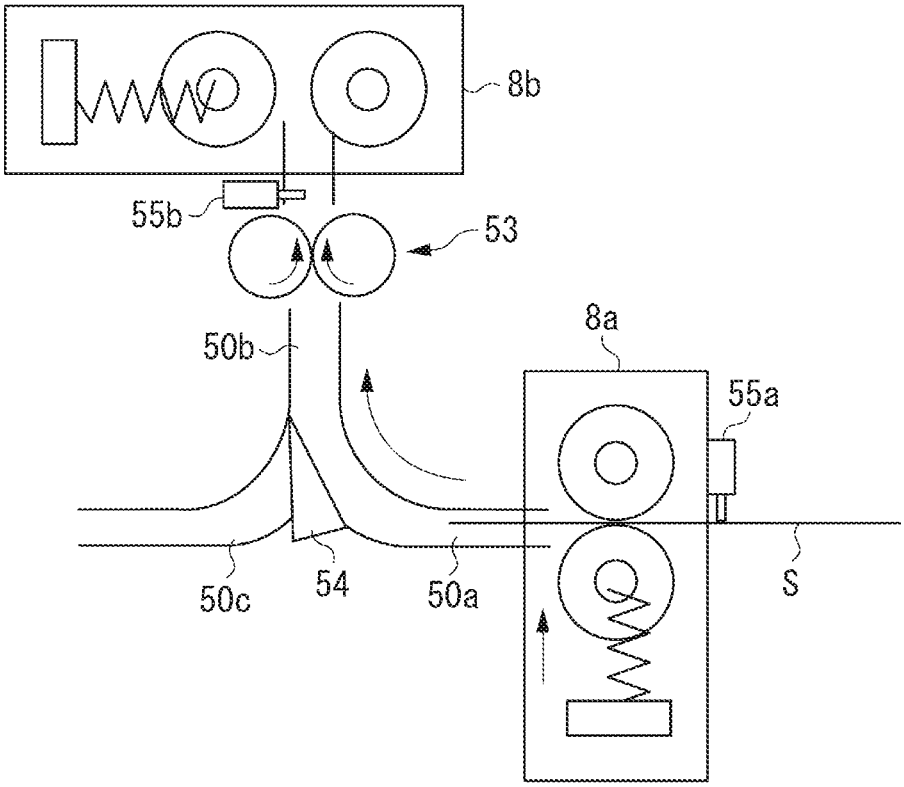
FIG. 9A illustrates a first pressure application unit compressing a trailing edge of a sheet according to a second exemplary embodiment.
Figure 9B:
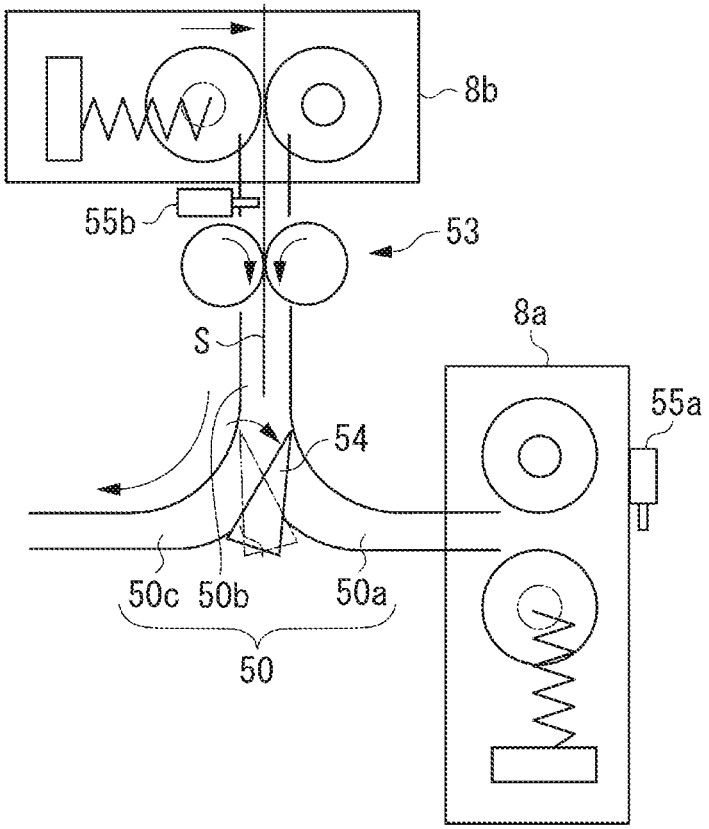
FIG. 9B illustrates a second pressure application unit compressing a leading edge of the sheet according to the second exemplary embodiment.

FIG. 9A illustrates the first pressure application unit 8*a* compressing the trailing edge of a sheet according to the second exemplary embodiment. FIG. 9B illustrates the second pressure application unit 8*b* compressing the leading edge of a sheet according to the second exemplary embodiment.

As illustrated in FIG. 1, the image forming apparatus 1A according to the second exemplary embodiment includes the sheet feeding unit 2, the image forming unit 3, the transfer unit 4, a sheet compression apparatus 5A, the fixing unit 6, and the discharging unit 7. The sheet compression apparatus 5A compresses the sheet S conveyed to the transfer unit 4 by applying pressure.

The sheet compression apparatus 5A includes the first pressure application unit 8*a*, the second pressure application unit 8*b*, the reversing conveyance roller pair 53, the flapper 54, and the leading edge detection sensors 55*a* and 55*b*. The second pressure application unit 8*b* is provided on the second conveyance path 50*b* opposite the connection portion of the first conveyance path 50*a* and the second conveyance path 50*b* with respect to the reversing conveyance roller pair 53. The leading edge detection sensor 55*b* is provided on the second conveyance path 50*b* on the side of the reversing conveyance roller pair 53 with respect to the second pressure application unit 8*b*.

Since the second pressure application unit 8*b* is arranged in parallel with the reversing conveyance roller pair 53, for example, the pressure application to the leading edge of the sheet S can be performed after the pressure application to the trailing edge of the sheet S even if the distance to the secondary transfer unit 43 is short.

Thus, the sheet thickness can be reduced without applying unnecessary load to the secondary transfer unit 43 or the drive system of the fixing unit 6. In this manner, the possibility of chipping of the fixing roller 60 and the pressure roller 61 of the fixing unit 6 can be reduced, and durability of the fixing roller 60 and the pressure roller 61 can be enhanced.

An image forming apparatus 1B according to a third exemplary embodiment of the present disclosure will be described with reference to FIGS. 10A and 10B as well as FIG. 1.

The image forming apparatus 1B according to the third exemplary embodiment is different from the image forming apparatus 1 according to the first exemplary embodiment in that the second pressure application unit 8*b* is not provided in the third conveyance path 50*c*. According to the third exemplary embodiment, points different from the first exemplary embodiment are mainly described, and components similar to those of the first exemplary embodiment are denoted by the same reference numerals and their descriptions are not repeated. According to the third exemplary embodiment, the components similar to those of the first exemplary embodiment produce effects similar to those of the first exemplary embodiment.

Figure 10A:
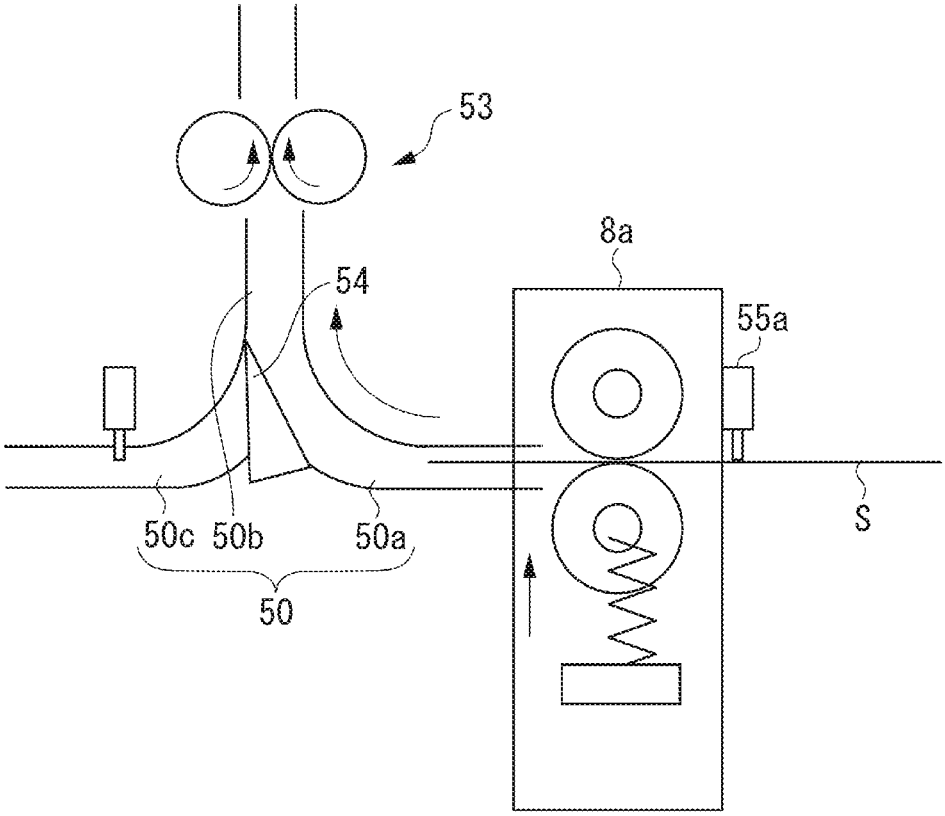
FIG. 10A schematically illustrates a sheet compression apparatus compressing the trailing edge of a sheet according to a third exemplary embodiment.
Figure 10B:
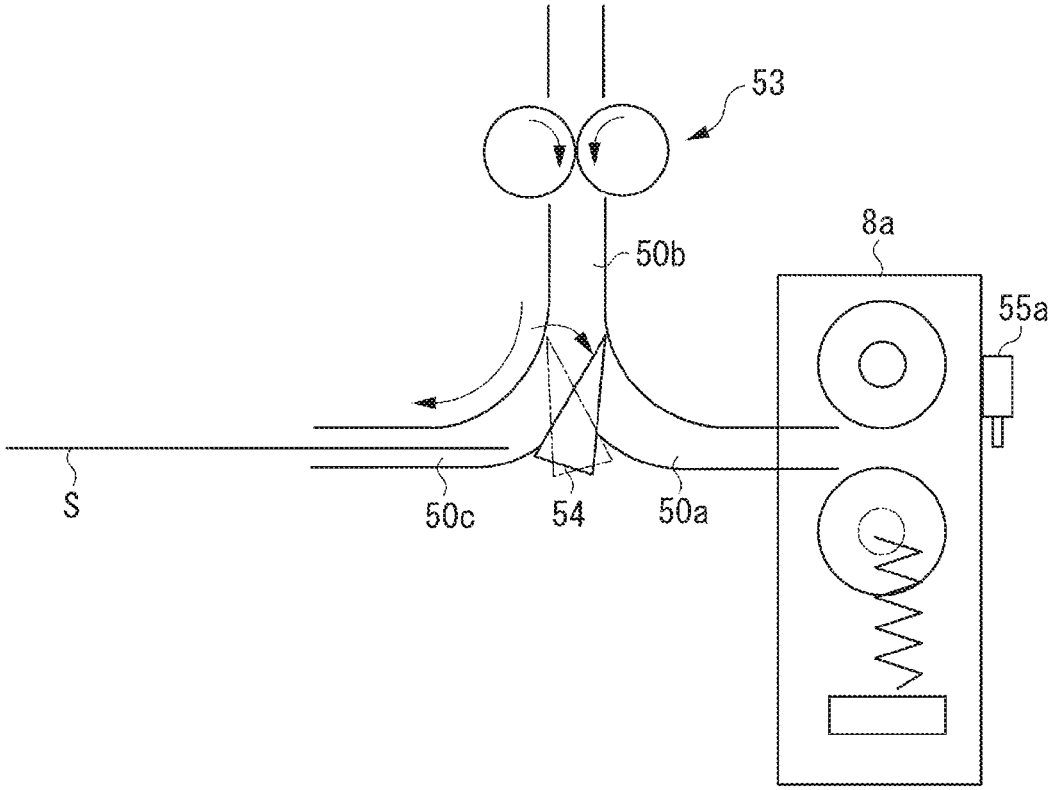
FIG. 10B schematically illustrates a conveyed sheet having the compressed trailing edge as the top end of the sheet in the conveyance direction.

FIG. 10A schematically illustrates a sheet compression apparatus 5B compressing the trailing edge of a sheet according to a third exemplary embodiment. FIG. 10B schematically illustrates the conveyed sheet having the compressed trailing edge as the top end of the sheet in the conveyance direction.

As illustrated in FIG. 1, the image forming apparatus 1B according to the third exemplary embodiment includes the sheet feeding unit 2, the image forming unit 3, the transfer unit 4, the sheet compression apparatus 5B which compresses the sheet S conveyed to the transfer unit 4 by an application of pressure, the fixing unit 6, and the discharging unit 7. The sheet compression apparatus 5B includes the first pressure application unit 8*a* provided on the first conveyance path 50*a*, the reversing conveyance roller pair 53 provided on the second conveyance path 50*b*, the flapper 54, and the leading edge detection sensor 55*a* provided on the first conveyance path 50*a*.

Since the first pressure application unit 8*a* is arranged on the first conveyance path 50*a* and the reversing conveyance roller pair 53 is provided on the second conveyance path 50*b*, the pressure can be applied to the trailing edge of the sheet when the sheet passes through the first pressure application unit 8*a*. Further, the sheet having its trailing edge as the top end of the sheet in the conveying direction can be conveyed to the secondary transfer unit 43.

Thus, the thickness of the leading edge and the lateral sides of the sheet onto which the image is transferred at the secondary transfer unit 43 and the nip portion of the fixing unit 6 can be reduced in advance. In this manner, the sheet thickness can be reduced without applying an unnecessary load to the drive system of the secondary transfer unit 43 or the fixing unit 6.

As a result, the possibility of chipping of the fixing roller 60 and the pressure roller 61 of the fixing unit 6 can be reduced and durability of the fixing roller 60 and the pressure roller 61 can be enhanced.

An image forming apparatus 1C according to a fourth exemplary embodiment will be described with reference to FIGS. 11A and 11B as well as FIG. 1.

The image forming apparatus 1C according to the fourth exemplary embodiment is different from the image forming apparatus 1A according to the second exemplary embodiment in that the first pressure application unit 8*a* is not provided on the first conveyance path 50*a*. According to the fourth exemplary embodiment, points different from the second exemplary embodiment are mainly described and components similar to those of the second exemplary embodiment are denoted by the same reference numerals and their descriptions are not repeated. According to the fourth exemplary embodiment, the components similar to those of the second exemplary embodiment produce effects similar to those of the second exemplary embodiment.

Figure 11A:
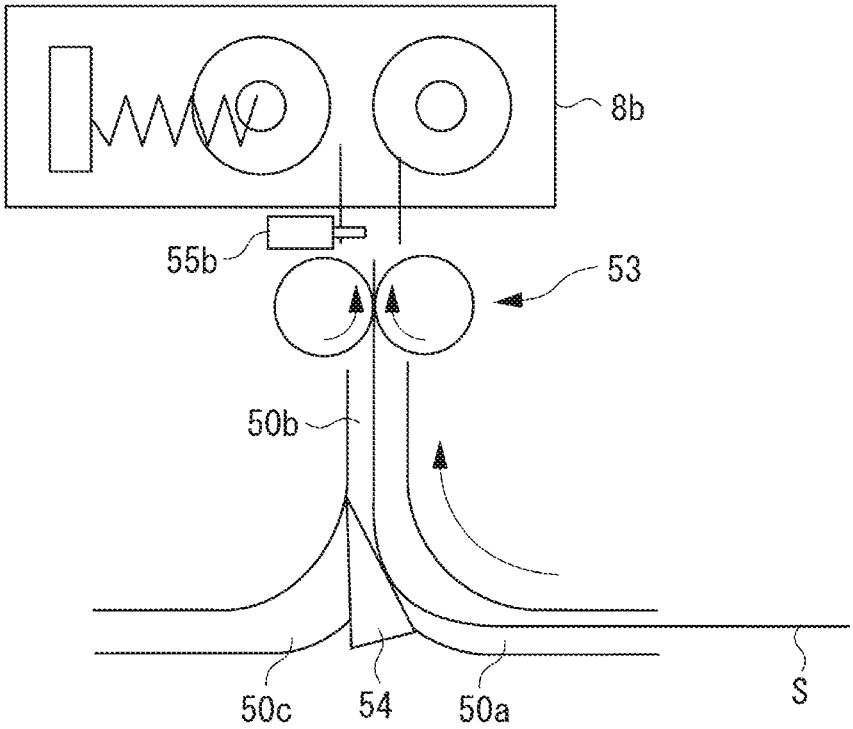
FIG. 11A schematically illustrates a sheet compression apparatus compressing the leading edge of a sheet according to a fourth exemplary embodiment.
Figure 11B:
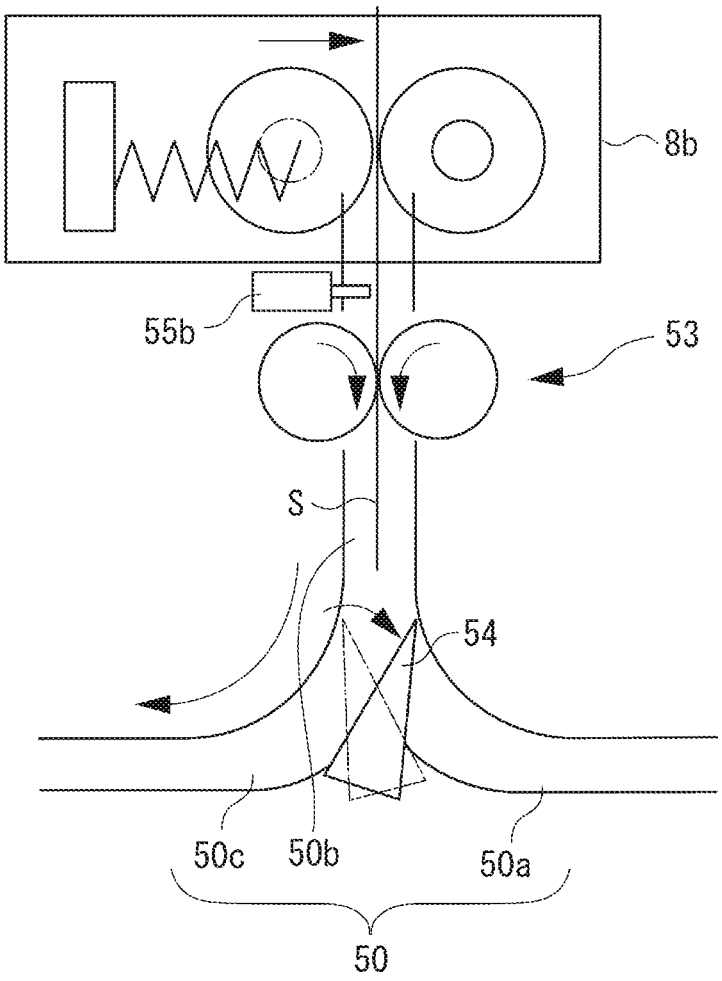
FIG. 11B schematically illustrates a conveyed sheet having the trailing edge as the top end of the sheet in the conveyance direction.

FIG. 11A schematically illustrates a sheet compression apparatus 5C compressing the leading edge of a sheet according to the fourth exemplary embodiment. FIG. 11B schematically illustrates a sheet having the compressed leading edge as the bottom end in the conveying direction conveyed to the third conveyance path 50*c*.

As illustrated in FIG. 11A, the image forming apparatus 1C according to the fourth exemplary embodiment includes the sheet feeding unit 2, the image forming unit 3, the transfer unit 4, the sheet compression apparatus 5C that compresses the sheet S conveyed to the transfer unit 4 by an application of pressure, the fixing unit 6, and the discharging unit 7. The sheet compression apparatus 5C includes the second pressure application unit 8*b*, the reversing conveyance roller pair 53, and the leading edge detection sensor 55*b* all of which are provided on the second conveyance path 50*b* and the flapper 54.

By arranging both the second pressure application unit 8*b* and the reversing conveyance roller pair 53 on the second conveyance path 50*b*, pressure can be applied to the leading edge of the sheet by the second pressure application unit 8*b*. The sheet is conveyed to the secondary transfer unit 43 having the trailing edge of the sheet as the top end in the conveying direction. Thus, the thickness of the leading edge (bottom end of the sheet in the conveying direction) and the lateral sides of the sheet onto which the image is transferred at the secondary transfer unit 43 and the nip portion of the fixing unit 6 can be reduced in advance.

In this manner, for example, chipping of the fixing roller 60, and the pressure roller 61 of the fixing unit 6 can be reduced and durability of the fixing roller 60 and the pressure roller 61 can be enhanced.

The present invention is not limited to the exemplary embodiments described above. Further, the effects according to the exemplary embodiments of the present invention are those of the most useful effects, and the effects obtained from the present invention are not limited to the effects described in the exemplary embodiments.

Further, although the metal rollers 80*a* and 80*b* are set in standby in a separated state, and the metal roller 80*b* moves closer to the metal roller 80*a* after the leading edge of the sheet S passes between the metal rollers 80*a* and 80*b* so that pressure is applied to the sheet S according to the exemplary embodiments described above, the present invention is not limited to such a configuration. For example, the metal rollers 80*a* and 80*b* can be set in standby in a contact state. In this state, the first pressure amount P1 is applied. When the leading edge of the sheet S passes between the metal rollers 80*a* and 80*b*, the second pressure amount P2 can be applied.

Further, although the metal rollers 80*a* and 80*b* are used as a pair of nipping members according to the exemplary embodiments described above, the metal rollers of the present invention are not limited to such rollers. The type of the pair of nipping members is not limited so long as the pair of nipping members can apply pressure to the leading edge and the trailing edge of the sheet S to reduce the sheet thickness.

Further, according to the first and the second exemplary embodiments, after the pressure is applied to the trailing edge of the sheet S by the first pressure application unit 8*a*, the pressure is applied to the portion including the leading edge where the pressure is not yet applied to by the second pressure application unit 8*b* and the pressure is applied to the entire sheet. However, the present invention is not limited to such a configuration. In other words, any configuration is possible so long as the first pressure application unit 8*a* or the second pressure application unit 8*b* can at least apply pressure to the leading edge or the trailing edge of the sheet.

Further, although the rocking cams 89*a* and 89*b* are described as the pressure application adjustment devices which can change the pressure according to the exemplary embodiments, such devices are not limited to the rocking cams according to the present invention. The configuration of the pressure application adjustment device is not limited so long as the movement amount of the metal roller 80*b* is adjusted and the pressure application by the metal rollers 80*a* and 80*b* can be adjusted.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-179666 filed Aug. 19, 2011, which is hereby incorporated by reference herein in its entirety.

What is claimed is:

1. An image forming apparatus comprising:

a sheet feeding unit configured to feed a sheet;

a pair of first nipping members configured to compress the sheet fed by the sheet feeding unit while the sheet is nipped and configured to be separatable from each other;

a first separation mechanism configured to perform a separation operation of the pair of first nipping members;

a pair of second nipping members configured to compress the sheet nipped by the pair of first nipping members while the sheet is nipped and configured to be separatable from each other;

a second separation mechanism configured to perform a separation operation of the pair of second nipping members;

an image forming unit configured to form an image on the sheet nipped by the pair of first nipping members and the pair of second nipping members;

a conveyance switching unit having a reversely-rotatable roller which normally rotates and conveys the sheet compressed by the pair of first nipping members and then, which reversely rotates and conveys the sheet to switch the sheet conveying direction of the sheet compressed by the pair of first nipping members; and a controlling portion controls the first separation mechanism so after a first end of the sheet as a leading edge in a sheet conveying direction passes between the pair of first nipping members, the first separation mechanism relatively moves the pair of first nipping members closer to each other to nip the sheet, and then the pair of first nipping members compresses a second end of the sheet as a trailing edge in the sheet conveying direction, and controls so after the first end of the sheet leading edge in the sheet conveying direction passes between the pair of second nipping members, the second separation mechanism relatively moves the second nipping members closer to each other to nip the sheet and the conveyance switching unit switches sheet conveying direction of the sheet, and then the pair of second nipping members compresses the first end of the sheet as the trailing edge in the sheet conveying direction.

2. The image forming apparatus according to claim 1, wherein the first separation mechanism includes a pressure application adjustment unit which can change a pressing force applied to the sheet by adjusting a movement amount of the pair of first nipping members.

3. The image forming apparatus according to claim 1, wherein the pair of first nipping members is a first roller pair which applies pressure to the sheet by nipping the sheet.

4. The image forming apparatus according to claim 1, wherein the pair of first nipping members reduces the sheet thickness.

5. The image forming apparatus according to claim 1, wherein the pair of first nipping members is a pair of metal rollers.

6. The image forming apparatus according to claim 1, wherein the pair of first nipping members is longer than a width of a sheet in a width direction crossing to a sheet conveying direction.

7. The image forming apparatus according to claim 1, wherein the pair of second nipping members is a pair of metal rollers.

8. The image forming apparatus according to claim 1, wherein the pair of second nipping members is longer than a width of a sheet in a width direction crossing to a sheet conveying direction.

9. A sheet compression apparatus provided between a sheet feeding unit configured to feed a sheet and an image forming unit and configured to form an image on a sheet fed from the sheet feeding unit, and configured to compress the sheet fed by the sheet feeding unit before the image forming unit forms an image on the sheet, the apparatus comprising:

a pair of first nipping members configured compress the sheet while the sheet is nipped and to be separatable from each other, a first separation mechanism configured to perform a separation operation of the pair of first nipping members, and a pair of second nipping members configured to compress the sheet nipped by the pair of first nipping members while the sheet is nipped and configured to be separatable from each other;

a second separation mechanism configured to perform a separation operation of the pair of second nipping members;

a conveyance switching unit having a reversely-rotatable roller which normally rotates and conveys the sheet compressed by the pair of first nipping members and then, which reversely rotates and conveys the sheet to switch the sheet conveying direction of the sheet compressed by the pair of first nipping members, and a controlling portion controls the first separation mechanism so after a first end of the sheet as a leading edge in a sheet conveying direction passes between the pair of first nipping members, the first separation mechanism relatively moves the pair of first nipping members closer to each other to nip the sheet, and then the pair of first nipping members compresses a second end of the sheet as a trailing edge in the sheet conveying direction, and controls so after the first end of the sheet leading edge in the sheet conveying direction passes between the pair of second nipping members, the second separation mechanism relatively moves the second nipping members closer to each other to nip the sheet and the conveyance switching unit switches sheet conveying direction of the sheet, and then the pair of second nipping members compresses the first end of the sheet as the trailing edge in the sheet conveying direction.

* * * * *